US011078037B2

(12) United States Patent
Bernacchi

(10) Patent No.: US 11,078,037 B2
(45) Date of Patent: Aug. 3, 2021

(54) ROLLER CONVEYING UNIT FOR CONVEYING A SHEET BY MEANS OF ASPIRATION

(71) Applicant: Andrea Bernacchi, Montecarlo (IT)

(72) Inventor: Andrea Bernacchi, Montecarlo (IT)

( * ) Notice: Subject to any disclaimer, the term of this patent is extended or adjusted under 35 U.S.C. 154(b) by 0 days.

(21) Appl. No.: 16/771,083

(22) PCT Filed: Dec. 11, 2018

(86) PCT No.: PCT/IB2018/059862
§ 371 (c)(1),
(2) Date: Jun. 9, 2020

(87) PCT Pub. No.: WO2019/116216
PCT Pub. Date: Jun. 20, 2019

(65) Prior Publication Data

US 2021/0078815 A1 Mar. 18, 2021

(30) Foreign Application Priority Data

Dec. 15, 2017 (IT) ..... 102017000144895
May 23, 2018 (IT) ..... 102018000005619

(51) Int. Cl.
*B65H 5/22* (2006.01)
*B65H 27/00* (2006.01)
(Continued)

(52) U.S. Cl.
CPC ..... *B65H 5/226* (2013.01); *B65H 27/00* (2013.01); *B65H 45/24* (2013.01); *B65H 45/28* (2013.01); *B65H 2406/36* (2013.01)

(58) Field of Classification Search
CPC ..... B65H 5/22; B65H 5/226; B65H 27/00; B65H 45/24; B65H 2406/361; B65H 2406/3612; B65H 2406/3614
See application file for complete search history.

(56) References Cited

U.S. PATENT DOCUMENTS 3,533,618 A * 10/1970 Carstens ..... B65H 5/226 271/276
3,976,291 A * 8/1976 Bernardi ..... B65H 3/10 271/94

(Continued)

FOREIGN PATENT DOCUMENTS

EP 1449799 A1 8/2004

*Primary Examiner* — Jason L Vaughan
(74) *Attorney, Agent, or Firm* — R. Neil Sudol; Henry D. Coleman

(57) ABSTRACT

A conveying unit includes a rotatable roller having a first through-hole between the inside and the outside of the roller. A cylindrical member inside the roller has an opening and defines an annular chamber between the member and the roller. An insert borne by the roller inserted in the first through-hole thereof and contacting an external surface of the cylindrical member has a second through-hole in communication with the outside of the roller and extending through the first through-hole and the annular chamber. The first through-hole of the opening is configured such that, when the roller rotates, the insert transits at the opening, temporarily placing the outside of the roller in fluid communication with the annular chamber via the second through-hole, so that a sheet outside the roller and at the first through-hole is pulled against the roller by aspirating means and is conveyed.

14 Claims, 9 Drawing Sheets

(51) Int. Cl.
*B65H 45/24* (2006.01)
*B65H 45/28* (2006.01)

(56) References Cited

U.S. PATENT DOCUMENTS

| | | | | | |
|---|---|---|---|---|---|
| 4,260,146 | A * | 4/1981 | Mitzel | B65H 3/10 | 221/211 |
| 4,345,752 | A * | 8/1982 | Nakamura | B65H 3/10 | 271/104 |
| 5,149,554 | A | 9/1992 | Abler | | |
| 5,480,137 | A * | 1/1996 | Haupenthal | B41F 21/102 | 137/624.15 |
| 6,038,976 | A * | 3/2000 | Helmstadter | B41F 21/102 | 101/174 |
| 8,852,068 | B2 * | 10/2014 | Kauppila | B65H 27/00 | 493/454 |
| 8,939,445 | B2 * | 1/2015 | Schoultz | B65H 45/16 | 271/108 |
| 9,315,331 | B2 * | 4/2016 | Gieser | B65G 29/00 | |
| 9,862,112 | B2 * | 1/2018 | McCabe | B26F 3/004 | |
| 9,944,487 | B2 * | 4/2018 | McCabe | B65H 35/08 | |
| 2002/0066385 | A1 | 6/2002 | McIlwraith | | |
| 2004/0159999 | A1 * | 8/2004 | Dematteis | B65H 45/28 | 271/264 |
| 2012/0065045 | A1 * | 3/2012 | De Matteis | B65H 27/00 | 493/442 |

* cited by examiner

ROLLER CONVEYING UNIT FOR CONVEYING A SHEET BY MEANS OF ASPIRATION

FIELD OF THE INVENTION

The present invention relates to the technical sector concerning roller conveyors of reeled sheets or single sheets, for example paper sheets. These roller conveyors are equipped with roller conveying units which, during the conveying of the sheets, carry out cutting, folding or interleaving operations of the sheets.

In particular, the present invention refers to a roller conveying unit for conveying a sheet by means of aspiration.

DESCRIPTION OF THE PRIOR ART

It is known that the above-mentioned roller conveying units, in general, first carry out the sheet-cutting operations in reels into single sheets, for example paper sheets, using blades present on the external surface of the roller. Thereafter, the units convey the paper sheets in a predetermined advancement direction and, at the same time, carry out the folding and interleaving operations of a plurality of sheets with respect to one another. These roller conveying units carry out the above operations with the use of aspirating means which ensure adherence of the paper sheet to the external surface of the roller, as the paper sheet is aspirated against the external surface of the roller because of the depression generated thereby.

A known roller conveying unit for conveying a sheet by means of aspiration comprises: a frame; a roller which is activatable in rotation with respect to the axis thereof, which is internally hollow and which comprises a plurality of through-holes which set the outside of the roller in fluid communication with the inside of the roller; a tubular member which is arranged internally of the roller, which is concentric to the frame and which is solidly constrained to the frame. An annular chamber is thus defined between the external surface of the tubular member and the internal surface of the roller. Differently, the hollow part of the tubular member defines an internal chamber. Further, the tubular element comprises a second plurality of through-holes which place the annular chamber in fluid communication with the internal chamber. The roller conveying unit of known type further comprises: aspirating means for creating a depression in the internal chamber; two inserts that are fixed to the tubular element, and which extend in a radial direction from the external surface of the tubular element up to contacting the internal surface of the roller. The two inserts are therefore arranged in the annular chamber. Further, the two inserts are fixed to the tubular element by screws and subdivide the annular chamber into two sub-chambers: the first sub-chamber is under depression, as it is in fluid communication with the internal chamber via the second plurality of through-holes, while the second sub-chamber is a chamber kept at atmospheric pressure, as it is in fluid communication with the outside of the roller via the first plurality of through-holes. During the conveying, the roller rotates with respect to the own axis thereof, contacting the two inserts with the internal surface thereof. When a first through-hole of the first plurality of through-holes transits at the first sub-chamber, the first through-hole places the internal chamber in fluid communication with the outside of the roller. Consequently, a sheet located at the first through-hole adheres to the external surface of the roller by action of the depression generated by the aspirating means. In the same way, when the first through-hole of the first plurality of through-holes transits at the second sub-chamber, the first through-hole places the second sub-chamber in fluid communication, as mentioned at atmospheric pressure, with the outside of the roller and the sheet is no longer subject to the depression generated by the aspirating means, and is thus able to detach from the external surface of the roller.

Though the two inserts are made of a self-lubricating material, due to the continuous dragging of the internal surface of the roller thereon, the two inserts tend to be subject to rapid wear.

Further, the use of the two inserts is greater at the time when they tend to accumulate dust in the second sub-chamber, for the reasons set out in the following. The dust generally derives from the cutting operations and tends to adhere to the sheet being conveyed. When the roller rotates to convey the sheet, the holes of the first plurality of holes, even if not located at the first sub-chamber, are affected by a residual aspiration force; this aspiration force tends to collect the dust from the sheet and convey the dust towards the second sub-chamber, internally of which the dust, not being subject to aspirating means, tends to accumulate, in particular at the insert arranged downstream with respect to the rotation direction of the roller. Further, with the continuous rotation of the roller with respect to the axis thereof, the dust present in the second sub-chamber tends to insinuate itself between the insert and the internal surface of the roller and be drawn, by the roller itself, into the first sub-chamber, accumulating at the other insert and also causing wear of the insert.

A further drawback is linked to the risk that with the use of the roller conveying unit, the tubular element can flex, with the consequence that the two inserts wear rapidly and lose contact with the internal surface of the roller, causing a drop in pressure in the first sub-chamber which could make the aspiration force that must be exerted on the sheets to be conveyed ineffective. The risk of flexion of the tubular element is due to the fact that as specified in the foregoing the first sub-chamber is in depression while the second sub-chamber is at atmospheric pressure, which generates forces on the tubular element which tend to cause it to flex. To obviate this drawback the tubular element is dimensioned with an augmented thickness to stiffen it, but this obviously makes the component especially expensive.

SUMMARY OF THE INVENTION

In the light of the above, the aim of the present invention consists in obviating the above-mentioned drawbacks.

The above aim is attained with a roller conveying unit for conveying a sheet by means of aspiration, according to claim 1 or claim 13.

The roller conveying unit of the present invention advantageously avoids the phenomenon of dust collection in the annular chamber: in fact, once the aspirating means have been activated, the dust is aspirated from the aspirating means in order to be conveyed towards the outside by the roller conveying unit. In other words, when the roller rotates to convey a sheet, on which dust is present, the roller takes with it the insert, so that the dust is affected, via the second through-hole, by the aspiration force generated by the aspirating means and is conveyed out of the roller conveying unit.

Then the dust crosses the annular chamber but is certain not to accumulate in the annular chamber: in fact, the annular chamber is maintained under depression when the aspirating means are activated.

Therefore this tends also to limit wear on the inserts.

A further advantage is to reduce the manufacturing costs of the roller conveying unit, in particular the manufacturing costs of the cylindrical member as the cylindrical member used in the roller conveying unit of the present invention can be less rigid and thinner than the tubular element of the roller conveying unit described in the prior art.

As mentioned in the foregoing, as the annular chamber is subject to a uniform pressure value, the forces acting on the cylindrical member will have more or less the same value.

BRIEF DESCRIPTION OF THE DRAWINGS

Specific embodiments of the invention will be described in the following part of the present description, according to what is set down in the claims and with the aid of the accompanying tables of drawings, in which:

DESCRIPTION OF THE PREFERRED EMBODIMENTS

Figure 1:
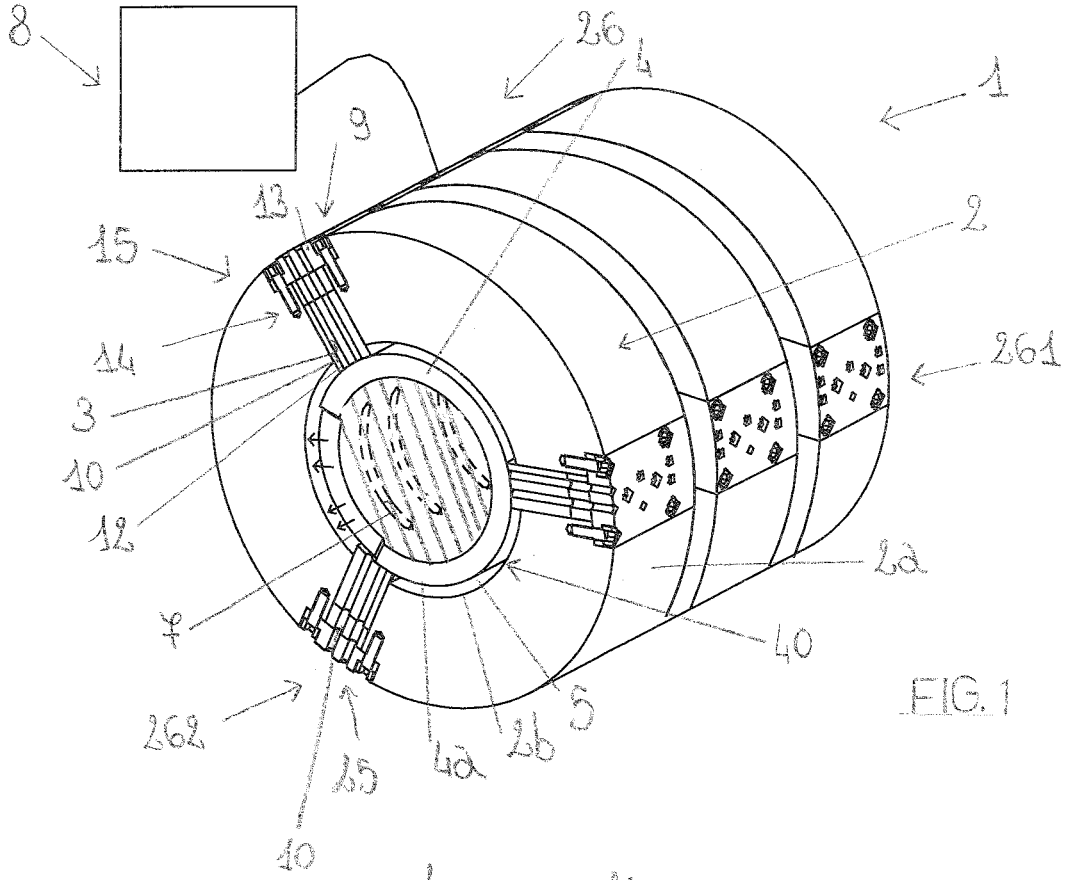
FIGS. 1 and 2 are two perspective views of a first embodiment and a further embodiment of a roller conveying unit, object of the present invention, in which different components of the roller conveying unit have been highlighted.

With reference to the appended tables of drawings, reference numeral (1) denotes a roller conveying unit for conveying a sheet by means of aspiration, object of the present invention.

A roller conveying unit (1) for conveying a sheet (11) by means of aspiration, comprising: a roller (2) which is activatable in rotation with respect to the axis thereof, which is internally hollow and which comprises a first through-hole (3) which sets the outside of the roller (2) in fluid communication with the inside of the roller (2); a cylindrical member (40) which is arranged internally of the roller (2) and which is concentric to the roller (2). An annular chamber (5) being thus defined between the external surface (4*a*) of the cylindrical member (40) and the internal surface (2*b*) of the roller (2). The cylindrical member (40) further comprises an opening (7). The roller conveying unit (1) further comprises aspirating means (8) for creating a depression in the annular chamber (5) and an insert (9). Further, the insert (9) is borne by the roller (2), is inserted in the first through-hole (3) of the roller (2), is dimensioned so as to contact the external surface (4*a*) of the cylindrical member (40) and comprises a second through-hole (10) which in turn is in communication with the outside of the roller (2) and extends through the first through-hole (3) and the annular chamber (5). The positions and the dimensions of the first through-hole (3) and of the opening (7) are selected in such a way that, when the roller (2) rotates with respect to the axis thereof, the insert (9) transits at the opening (7), temporarily placing the outside of the roller (2) in fluid communication with the annular chamber (5) via the second through-hole (10), so that a sheet (11) located on the outside of the roller (2) and at the first through-hole (3) is aspirated against the external surface (2*a*) of the roller (2) by action of the depression generated by the aspirating means (8), and is consequently conveyed (see FIG. 1).

It is specified that by opening (7) is meant a removal of material at the cylindrical member (40).

The cylindrical member (40) can be solidly filled (see FIGS. 1 and 16) or hollow.

The sheet (11) is permeable to air.

The sheet (11) is preferably a paper sheet (11).

Figure 2:
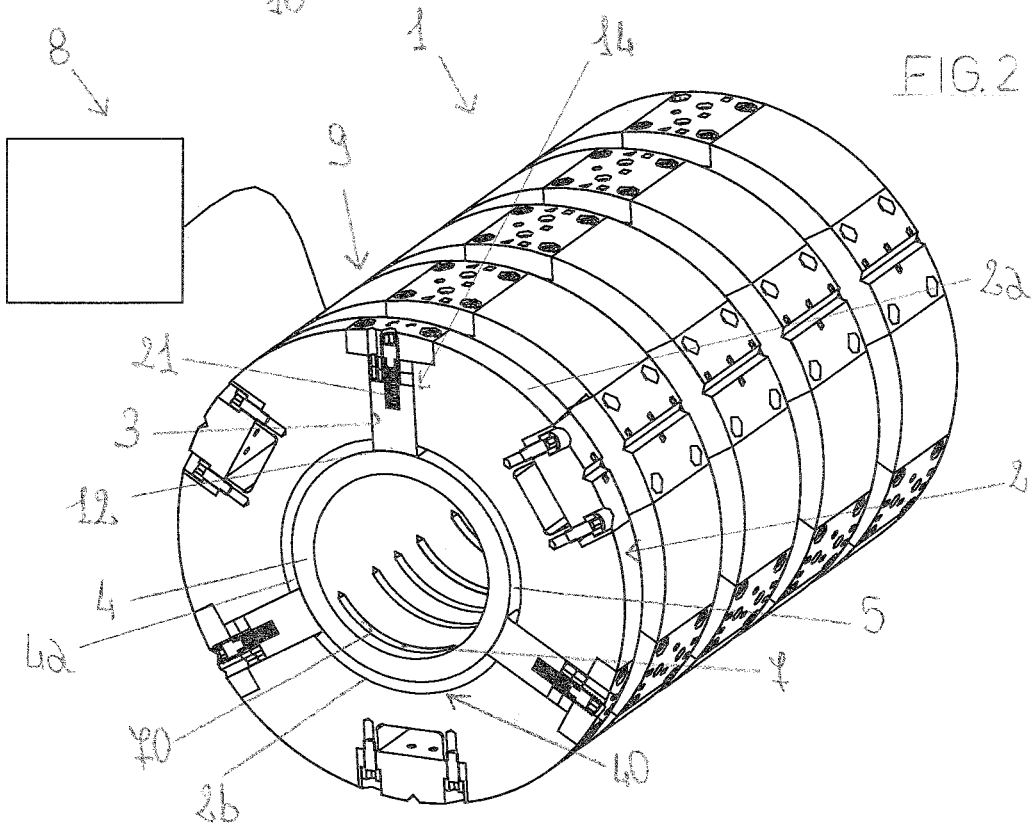

The roller (2) is preferably cylindrical (see FIGS. 1-2).

Figure 3:
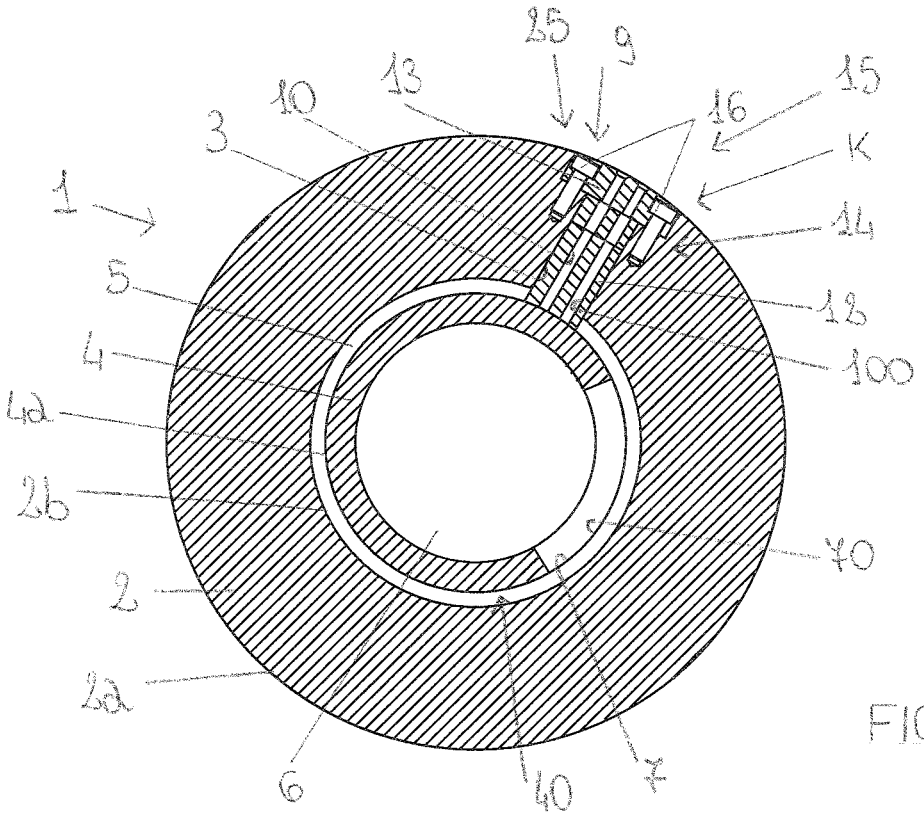
FIG. 3 is a front view of the roller conveying unit of FIG. 2.

The first through-hole (3) preferably extends in a radial direction internally of the roller (2) (see FIG. 3).

Further, the annular chamber (5) can be cylindrical (see FIGS. 1-2).

The roller conveying unit (1) preferably comprises a frame and the cylindrical member (40) is solidly constrained to the frame.

The aspirating means (8) can comprise an aspirating system which applies an aspiration force so that the relative pressure value internal of the annular chamber (5) is a lower value than atmospheric pressure.

The insert (9) preferably extends in a radial direction along the first through-hole (3) (see FIG. 3).

The second through-hole (10) preferably extends in a radial direction along the insert (9) (see FIG. 3).

The insert (9) is preferably extractable from outside the roller (2) in order to be replaced.

The insert (9) is advantageously insertable in the first through-hole (3) and/or extractable from the first through-hole (3) from outside the roller (2).

At the moment when the insert (9) tends to show wear, the substitution thereof with a new insert takes place rapidly and easily, as the worn insert (9) to be replaced is extractable from the first through-hole (3), from externally of the roller (2), and the new insert is insertable in the first through-hole (3) from outside the roller (2).

System halts are advantageously limited.

This aspect is advantageous with respect to the replacement modes of the two inserts of the roller conveying unit of the prior art, for the reasons set out in the following. In the prior art roller conveying units, replacing the two inserts with new inserts includes demounting the roller conveying unit, proceeding as follows: the roller is demounted from the frame of the roller conveying unit; the roller is separated from the cylindrical member to which the two inserts are fixed; thereafter, the two inserts are demounted from the cylindrical member by unscrewing the fastening screws. These operations are laborious and implicate a system halt. Further, considering the rapidity with which the two inserts wear, in a single year several replacements have to be made: therefore, in a year, with the roller conveying units of known type, there will be several incidences of system halt.

Figure 7:
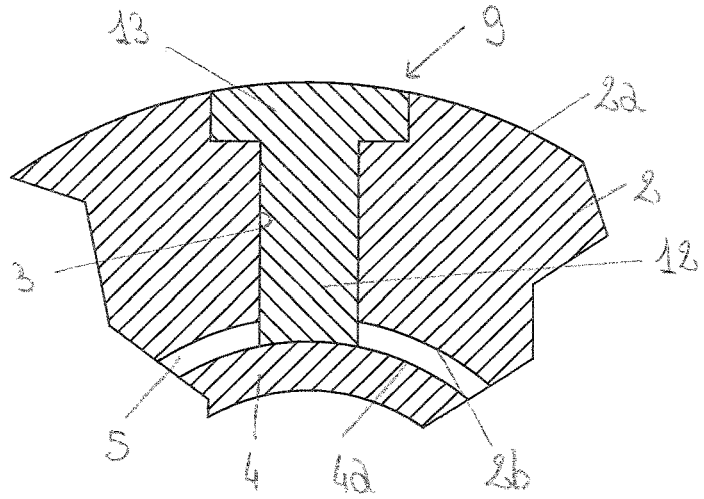
FIGS. 7-12 are views of different embodiments of detail K of FIG. 3.

In detail, with reference to FIG. 7, the insert (9) is in a single body. In this case, the insert (9) is extractable from the first through-hole (3) using pliers or hooked tools, by use of which the insert (9) is slid along the first through-hole (3) towards the outside of the roller (2).

The opening (7) is preferably shaped as a slit which extends along an arc of circumference of a corresponding transversal section of the cylindrical member (40) (refer to FIGS. 1 and 2).

In other words, with reference to FIGS. 1-3, the slit extends along the cylindrical member (40), in a circular trajectory, between two radii of the circumference delineated by the external surface (4*a*) of the cylindrical member (40).

The insert (9) preferably comprises: an internal portion (12) which crosses the annular chamber (5) up to contacting the external surface (4*a*) of the cylindrical member (40) and which is partly inserted in the first through-hole (3); an external portion (13) which is fixed to the roller (2); elastic means (14) which are interposed between the external portion (13) and the internal portion (12) and which are compressed so as to press the internal portion (12) against the external surface (4*a*) of the cylindrical member (40) and for progressively lengthening as the internal portion (12) gradually wears, thus guaranteeing in any case contact of the internal portion (12) against the external surface (4*a*) of the cylindrical member (40).

During the conveying of a paper sheet there is a continuous dragging on the internal portion (12) of the insert (9) on the external surface (4*a*) of the cylindrical member (40). For this reason, the internal portion (12) tends to be subject to wear during the use of the roller conveying unit (1) and there is consequently created a space between the internal portion (12) and the external surface (4*a*) of the cylindrical member (40). The elastic means (14) advantageously guarantee a greater working life of the insert (9) of the roller conveying unit (1), as the progressive lengthening of the elastic means (14) is such that the internal portion (12) fills the space created between the external surface (4*a*) of the cylindrical member (40) and the insert (9) following wear on the insert (9).

A further advantage is linked to the fact that the internal portion (12) is partly inserted in the first through-hole (3) so that when the latter wears due to the dragging on the external surface (4*a*) of the cylindrical member (40), it is pushed by the elastic means (14) along the first through-hole (3) to guarantee contact with the external surface (4*a*) of the cylindrical member (40). In other words, the first through-hole (3) is a guide for the passing of the insert (9) internally of the first through-hole (3) along the axis thereof (see FIG. 3).

The internal portion (12) is preferably made of a self-lubricating material.

The internal portion (12) made of a self-lubricating material advantageously reduces friction between the insert (9) and the internal surface (2*b*) of the roller (2).

Figure 8:
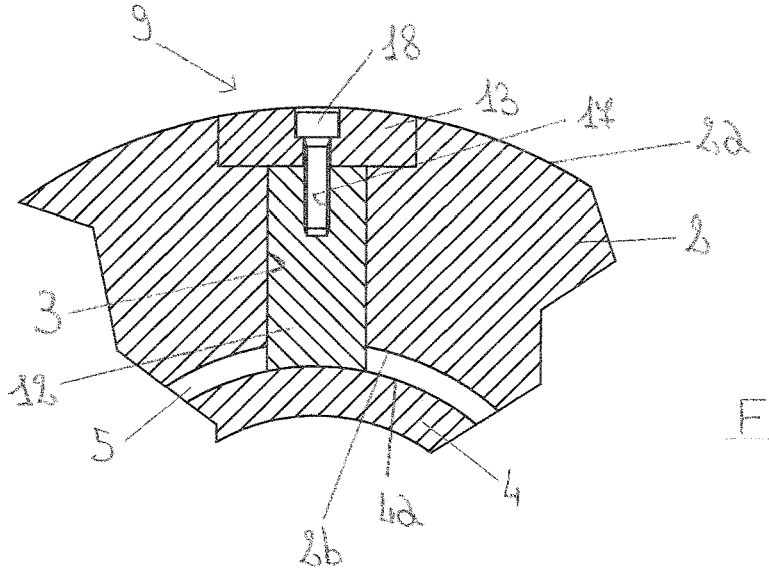

The internal portion (12) can contact the external portion (13) (see FIG. 8).

Figure 12:
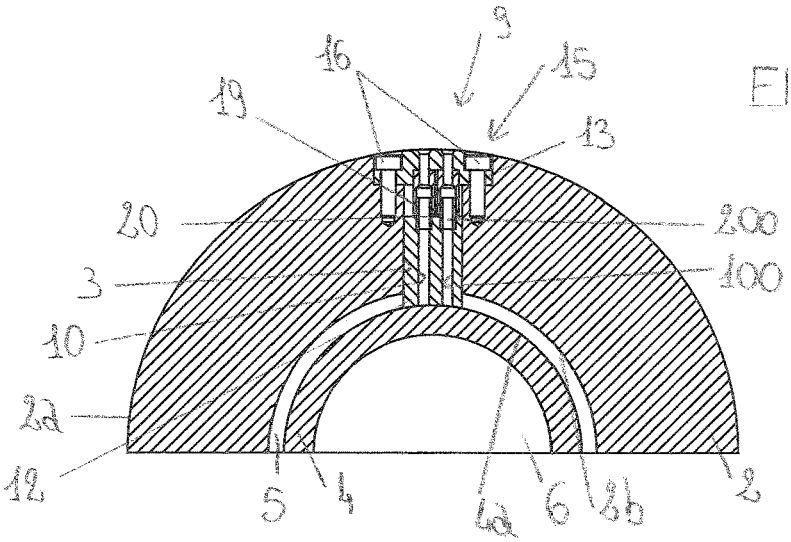

Alternatively, the insert (9) can comprise a volume (19) between the internal portion (12) and the external portion (13) (see FIG. 12).

The external portion (13) can be removably fixed to the roller (2) by fastening means to protect the insert (9) with respect to the outside of the roller (2) and to delineate a portion of the external surface (2*a*) of the roller (2). These fastening means can be, for example, two screws (16).

With reference to FIG. 3, the roller (2) comprises a pair of threaded seats (15) and the external portion (13) is fixed to the roller (2) by means of two screws (16) inserted in the pair of threaded seats (15).

Alternatively, with reference to FIG. 8, the internal portion (13) can be fixed to the external portion (12). The internal portion (12) can comprise a second threaded seat (17) which receives a second screw (18) which fixes the external portion (13) to the internal portion (12) of the insert (9).

The internal portion (12) and the external portion (13) of the insert (9) are extractable from outside the roller (2) in order to be replaced.

In this case, the insert (9) is extractable from the first through-hole (3) by initially unscrewing the second screw (18) in order to demount the external portion (13) and, subsequently, using pliers or hooked tools, by use of which the internal portion (12) is slid along the first through-hole (3) towards the outside of the roller (2).

In detail, a part of the second through-hole (10) is fashioned in the internal portion (12) and a part of the second through-hole (10) is fashioned in the external portion (13) (see FIGS. 1 and 3).

The insert (9) can comprise a telescopic conduit (20) which is inserted in the second through-hole (10) and between at least the internal portion (12) and the external portion (13).

With reference to FIG. 12, the telescopic conduit (20) crosses the volume (19) and with the relative external walls, once it is inserted in the internal portion (12) is in contact with the internal portion (12) and in the external portion (13).

With reference to FIG. 12, the telescopic conduit (20) connects the part of the second through-hole (10) fashioned in the internal portion (12) and the part of the second through-hole (10) fashioned in the external portion (13).

The telescopic conduit (20) tends to progressively lengthen, at the same time as the action of the elastic means (14), progressively as the internal portion (12) wears, ensuring the fluid communication between the annular chamber (5) and the outside of the roller (2).

The telescopic conduit (20) advantageously prevents the accumulation of air in the volume (19); this accumulation might take place during the conveying of a sheet (11), following the activating of the aspirating means (8). In other words, the telescopic conduit (20) creates a conveying path of the depression generated by the aspirating means (8) towards the outside, thus optimising the conveying operations.

Further, during the progress of the wear on the insert (9) a space is created between the external surface (4*a*) of the cylindrical member (40) and the insert (9). This space is filled by the action of the elastic means (14): the elastic means (14) intervene to press the internal portion (12) against the external surface (4*a*) of the cylindrical member (40). On the other hand, by pressing the internal portion (12) against the external surface (4*a*) of the cylindrical member (40), space might be created superiorly, between the internal portion (12) and the external portion (13).

The telescopic conduit (20) advantageously prevents the accumulation of air in the above-mentioned space.

Figure 9:
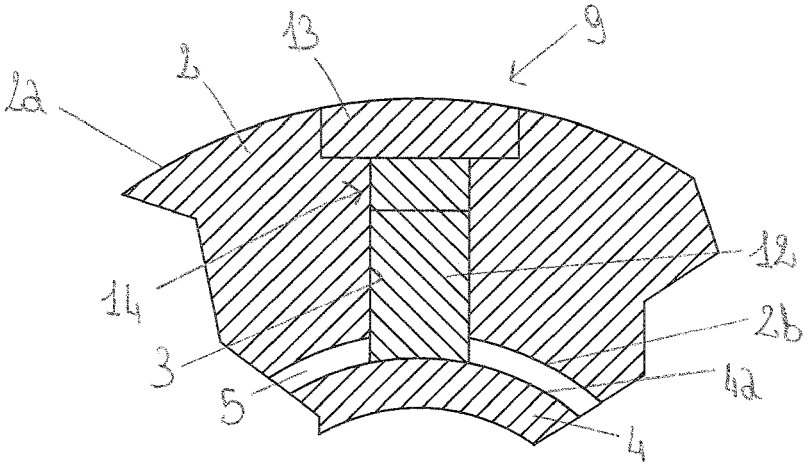

The elastic means (14) can form a further portion of the insert (9), can be made of an elastically deformable material and can be interposed between the external portion (13) and the internal portion (12) (see FIGS. 1 and 9).

The further portion of the insert (9), made of an elastically deformable material, can be in contact on one side with the internal portion (12) and on the other side with the external portion (13).

A further part of the second through-hole (10) is also fashioned in the further portion of the insert.

In this case, the insert (9) is extractable from the first through-hole (3) using pliers or hooked tools, through which the external portion (13), the elastic means (14) and the internal portion (12) are slid along the first through-hole (3) towards the outside of the roller (2).

The elastically deformable material can be, for example, foam rubber.

The elastic means (14) preferably comprise a spring (21) interposed between the external portion (13) and the internal portion (12). The internal portion (12) can comprise a housing (22) for a spring (21) which receives the spring (21) and the external portion (13) can comprise a first seat (23) for receiving regulating means for increasing or reducing the compression of the spring (21) (see FIG. 10).

Figure 11:
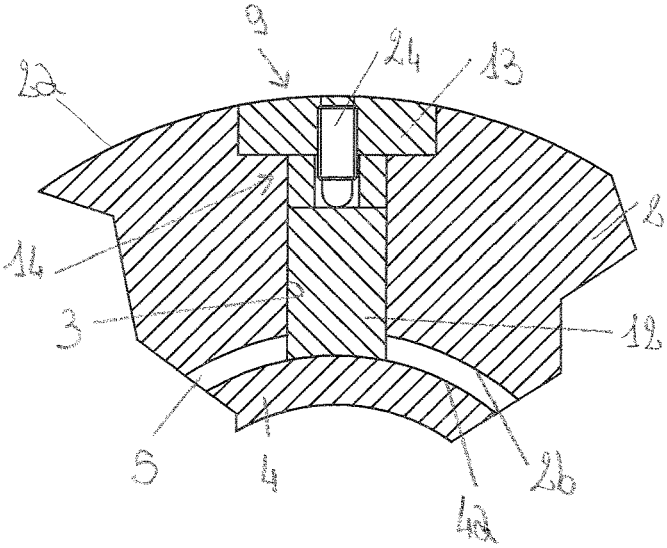

Alternatively, with reference to FIG. 11, the elastic means (14) comprise a gas spring (24), interposed between the external portion (13) and the internal portion (12), which presses the internal portion (12) against the external surface (4*a*) of the cylindrical member (40) by means of the relative rod which progressively lengthens as the internal portion (12) gradually wears, thus guaranteeing in any case contact of the internal portion (12) against the external surface (4*a*) of the tubular member (40).

The regulating means can be a regulating screw, for example.

In a case where the elastic means (14) are a spring (21) or a gas spring (24), the insert (9) is extractable from the first through-hole (3) by first demounting the external portion (13) and then demounting the spring (21) or the gas spring (24). The extraction of the latter, since they are solidly constrained to the internal portion (12), also leads to the extraction of the internal portion (12).

Figure 10:
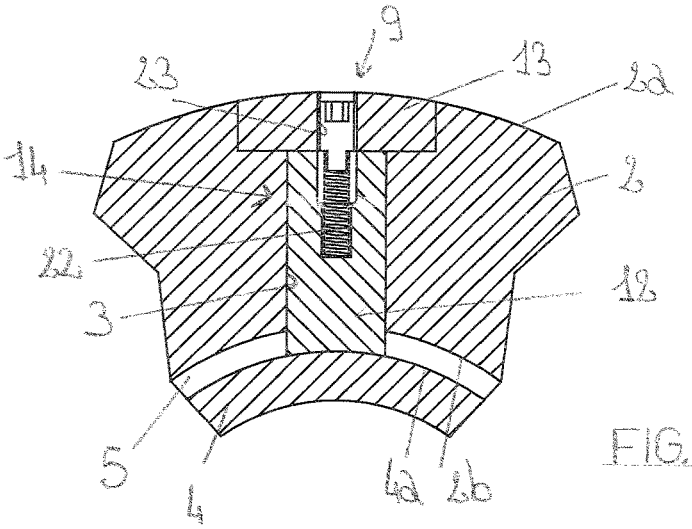

With reference to FIG. 10, the first seat (23), which receives the regulating means, can have a through-hole profile through which the regulating screw passes, for example, and in which a thread (nut screw) is made for helically coupling with the regulating screw. In this way the screwing or unscrewing of the regulating screw in the first seat (23) (nut screw) respectively determines a greater or lesser compression of the spring (21).

The insert (9) preferably comprises a first plurality of through-holes (25), which first plurality of through-holes (25) comprises the second through-hole (10); and the through-holes of the first plurality of through-holes (25) are arranged adjacent to one another along an arc of circumference of the roller (2) (see FIGS. 1 and 3).

The presence of the first plurality of through-holes (25) advantageously improves the carrying out of the cutting, folding and interleaving operations during the conveying of a sheet (11).

With reference to the illustrated figures, the first plurality of through-holes (25) comprises the second through-hole (10) and a fourth through-hole (100).

With reference to FIG. 12, the insert comprises a further telescopic conduit (200) which is inserted in the fourth through-hole (100).

The telescopic conduit (20) and the further telescopic conduit (200) advantageously prevent the accumulation of air in the volume (19); this accumulation might take place during the conveying of a sheet (11) and involves the phenomenon of friction between the second through-hole (10) and the fourth through-hole (100). In other words, the two telescopic conduits (20, 200) create a conveying path of the depression generated by the aspirating means (8) towards the outside of the roller (2).

Further, as mentioned in the foregoing, during the progress of the wear on the insert (9) a space is created between the external surface (4*a*) of the cylindrical member (40) and the insert (9). This space is filled by the action of the elastic means (14): the elastic means (14) intervene to press the internal portion (12) against the external surface (4*a*) of the cylindrical member (40). On the other hand, by pressing the internal portion (12) against the external surface (4*a*) of the cylindrical member (40), space might be created superiorly, between the internal portion (12) and the external portion (13).

The two telescopic conduits (20, 200) advantageously prevent the accumulation of air in the above-mentioned space, and therefore prevent the possibility of interference between the second through-hole (10) and the fourth through-hole (100).

Figure 15:
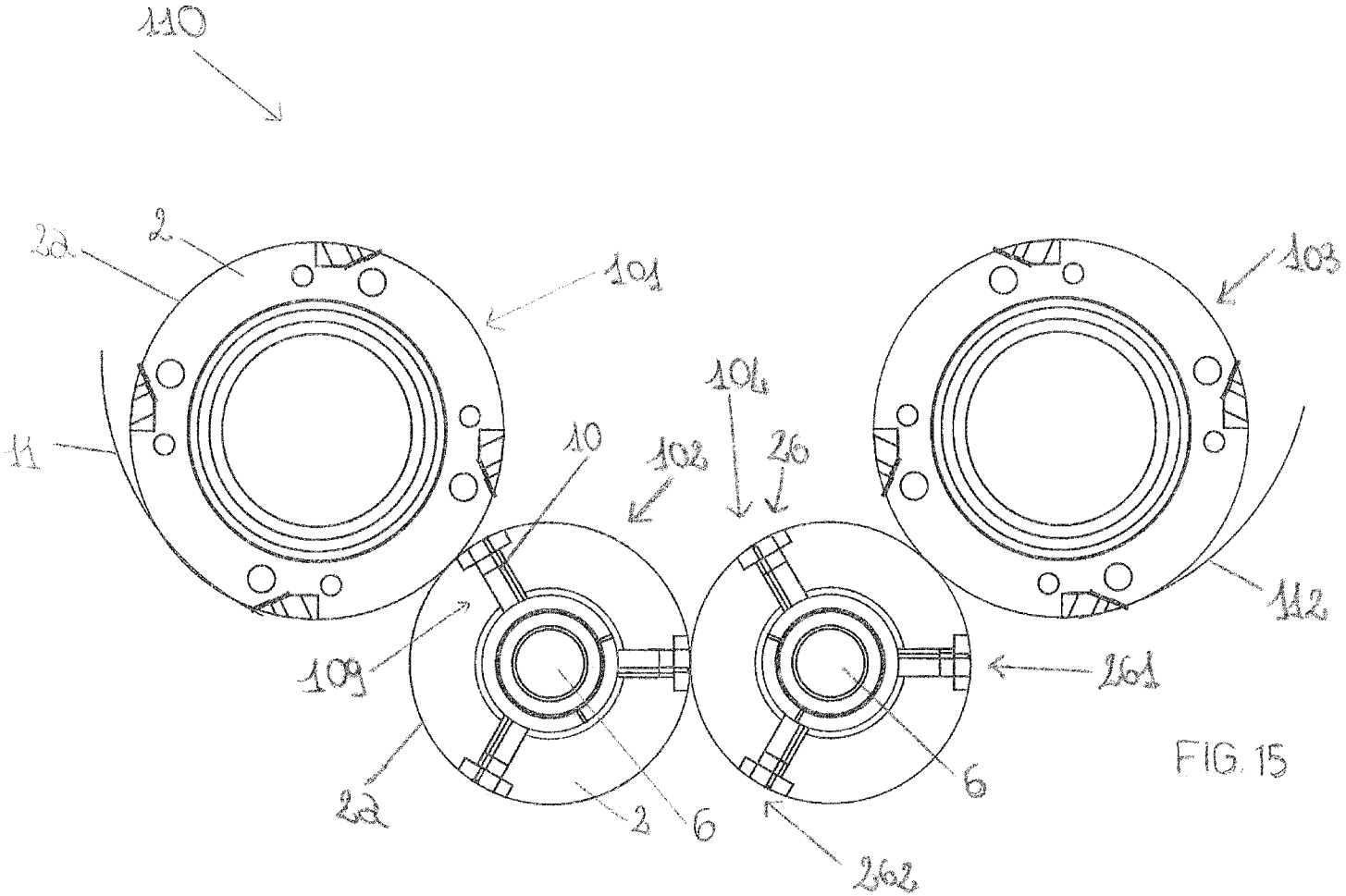
FIG. 15 is a schematic view of a plurality of roller conveying units which can carry out the cutting, folding and interleaving operations.

The roller (2) preferably comprises a second plurality of through-holes (26), which second plurality of through-holes (26) comprises the first through-hole (3); and wherein the through-holes of the second plurality of through-holes (26) are arranged adjacent to one another along an axis that is parallel to the axis of rotation of the roller (2) (see FIGS. 1 and 15).

In other words, the second plurality of through-holes (26) delineates a row of through-holes.

The through-holes of the second plurality of through-holes (26) are advantageously arranged adjacent to one another along an axis parallel to the axis of rotation of the roller (2) guarantee that, during the conveying of a sheet (11), the sheet (11) itself passes from one roller conveying unit (1) to another, staying aligned to the axis of rotation of the roller (2).

Further, the roller conveying unit can comprise a third plurality of through-holes (261) and a fourth plurality of through-holes (262) and the through-holes of the third plurality of through-holes (261) are arranged adjacent to one another along a second axis that is parallel to the axis of rotation of the roller (2) and the through-holes of the fourth plurality of through-holes (262) are arranged adjacent to one another along a second axis that is parallel to the axis of rotation of the roller (2) (see FIGS. 1-2).

Figure 16:
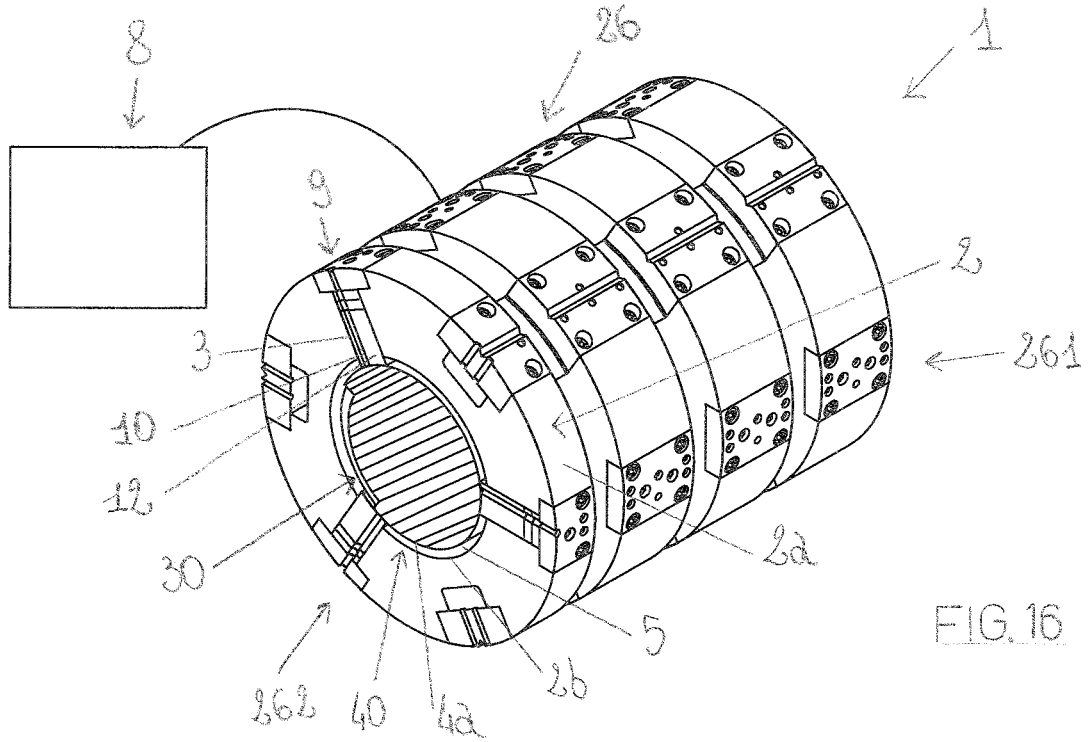
FIGS. 16 and 17 are respective perspective views of further embodiments of the roller conveying unit of the present invention.

With particular reference to FIG. 16, the opening (7) is an undercut (30).

The undercut (30) can be arranged at the external surface (4*a*) of the cylindrical member (40).

The following is a description of a second embodiment of the roller conveying unit of the present invention.

Figure 17:
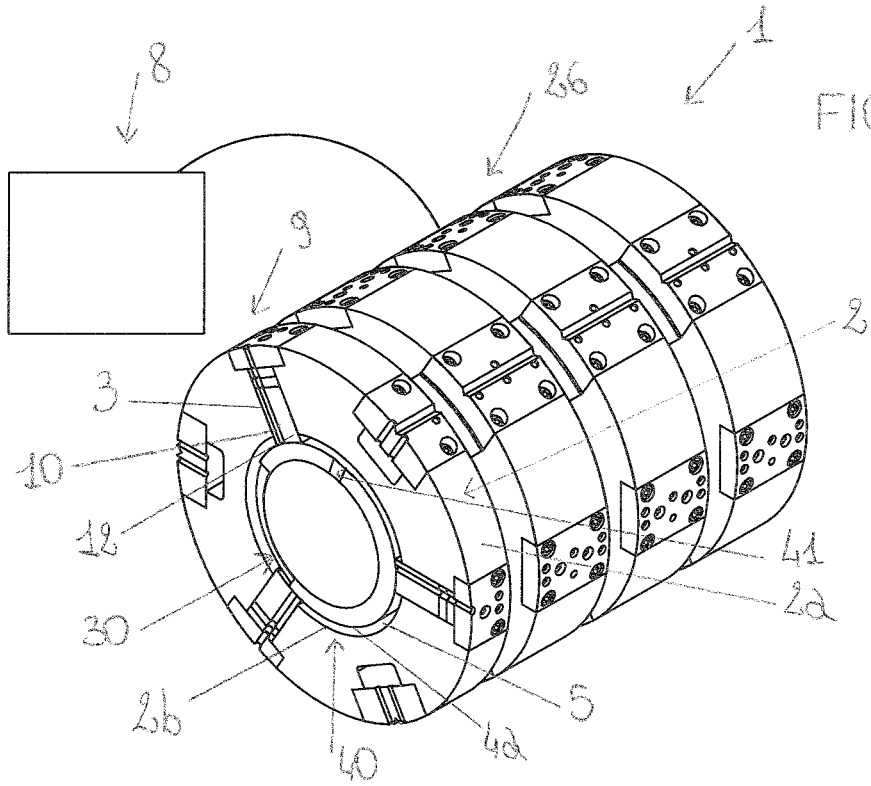
Figure 18:
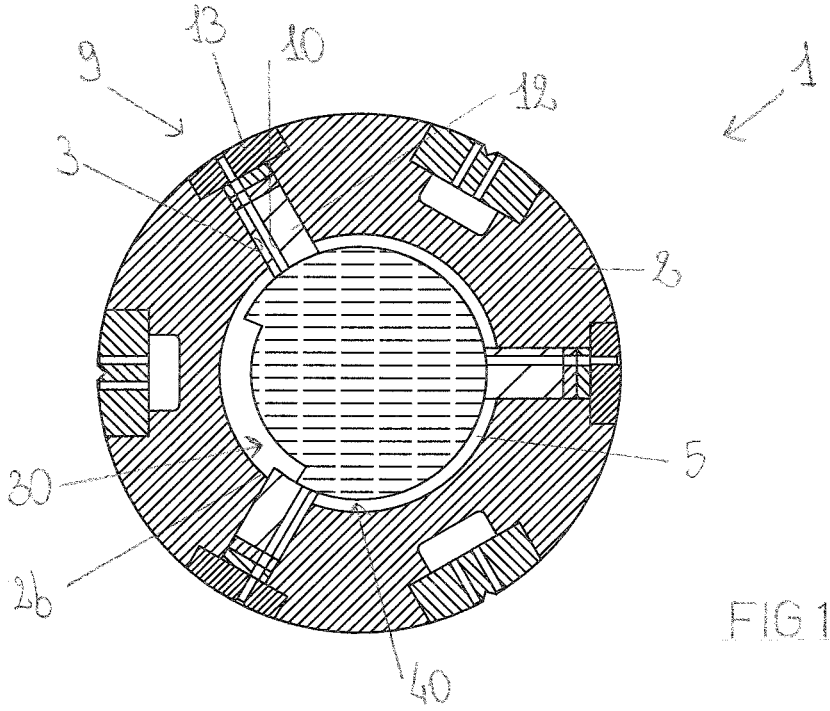
FIGS. 18 and 19 are front views respectively of FIG. 16 and FIG. 17.
Figure 19:
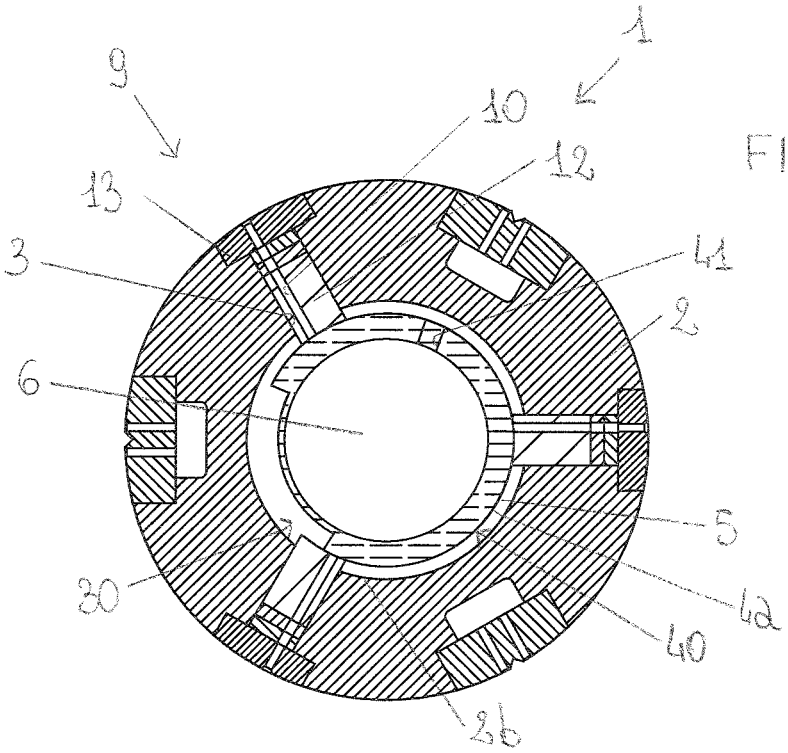

With reference to FIG. 17, the tubular member (40) is a tubular element (4) and the hollow part of the tubular element (4) defines an internal chamber (6); the aspirating means (8) are further suitable for creating a depression in the internal chamber (6); the tubular element (4) comprises a third through-hole (41) which places the annular chamber (5) in fluid communication with the internal chamber (6) (see FIGS. 17 and 19).

As the third through-hole (41) places the annular chamber (5) in fluid communication with the internal chamber (6), the aspiration force applied by the aspirating means (8) determines a relative pressure value that is lower than atmospheric pressure in the internal chamber (6) and in the annular chamber (5).

If the tubular element (4) is cylindrical, the internal chamber (6) can be cylindrical.

The source of depression of the aspirating means (8) applies an aspiration force so that the relative pressure value internal of the internal chamber (6) is a lower value than atmospheric pressure.

The aspirating means (8) can be in fluid communication with the internal chamber (6).

The same considerations made above for the first embodiment are also valid for the second embodiment and for the further embodiments described herein.

Further, in a third embodiment, see in particular FIG. 2, the cylindrical member (40) can be a tubular element (4) and the hollow part of the tubular element (4) defines an internal chamber (6). The aspirating means (8) are further suitable for creating a depression in the internal chamber (6); the opening (7) is a through-hole (70) which places the annular chamber (5) in fluid communication with the internal chamber (6).

If the tubular element (4) is cylindrical, the internal chamber (6) can be cylindrical.

As the opening (7) is a through-hole (70) which places the annular chamber (5) in fluid communication with the internal chamber (6), the aspiration force applied by the aspirating system determines a relative pressure value that is lower than the atmospheric pressure also in the annular chamber (5).

As the annular chamber (5) is always in fluid communication with the internal chamber (6), the dust that would tend to accumulate in the annular chamber (5) or the internal chamber (6) is advantageously aspirated externally of the roller conveying unit by action of the aspirating means (8).

The source of depression of the aspirating means (8) applies an aspiration force so that the relative pressure value internal of the internal chamber (6) is a lower value than atmospheric pressure.

If the second through-hole (70) is shaped as a slit which extends along an arc of circumference of a corresponding transversal section of the tubular element (4), by varying the extension of the slit along the tubular element (4), in particular along the circular trajectory, also the time in which the sheet (11), at the second through-hole (10), is advantageously aspirated against the external surface (2*a*) of the roller (2) will vary.

With reference to FIGS. 4-6 and 15, there follows a description of a functioning cycle of the roller conveying unit (1) of the present invention.

Figure 4:
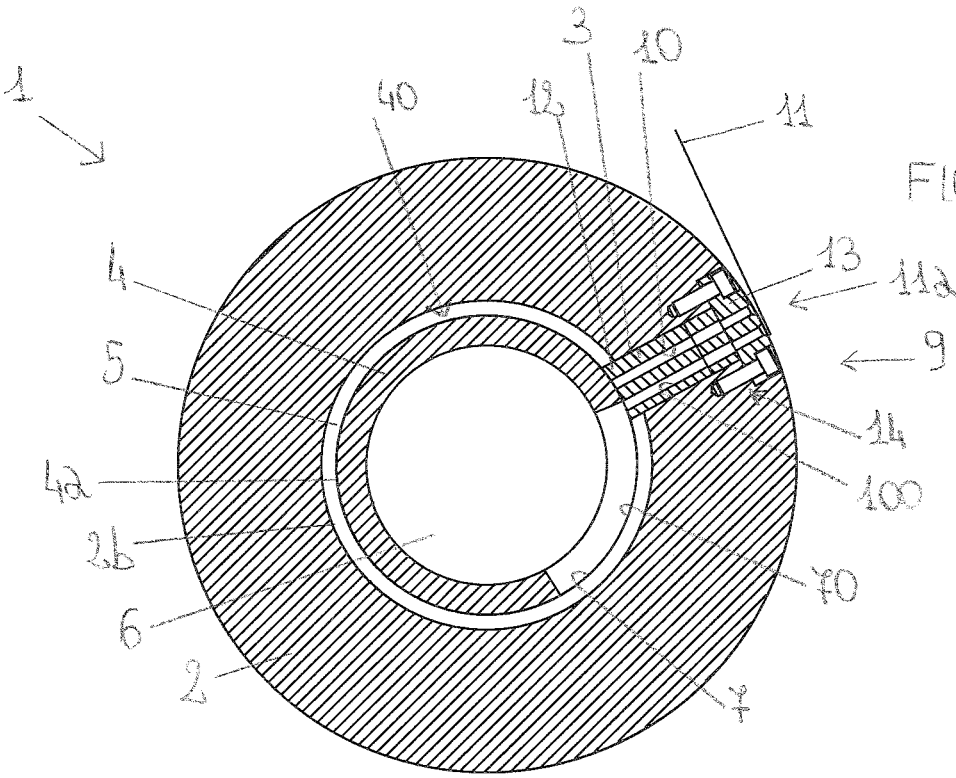
FIGS. 4-6 are front views illustrating a functioning cycle of the roller conveying unit of FIG. 2.
Figure 5:
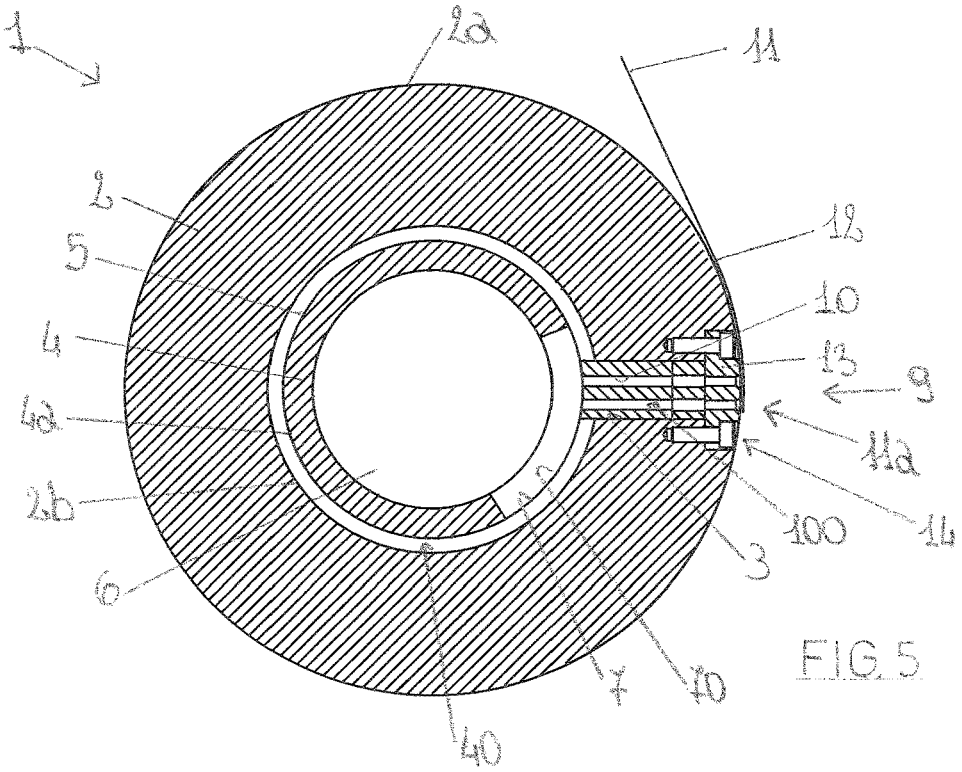
Figure 6:
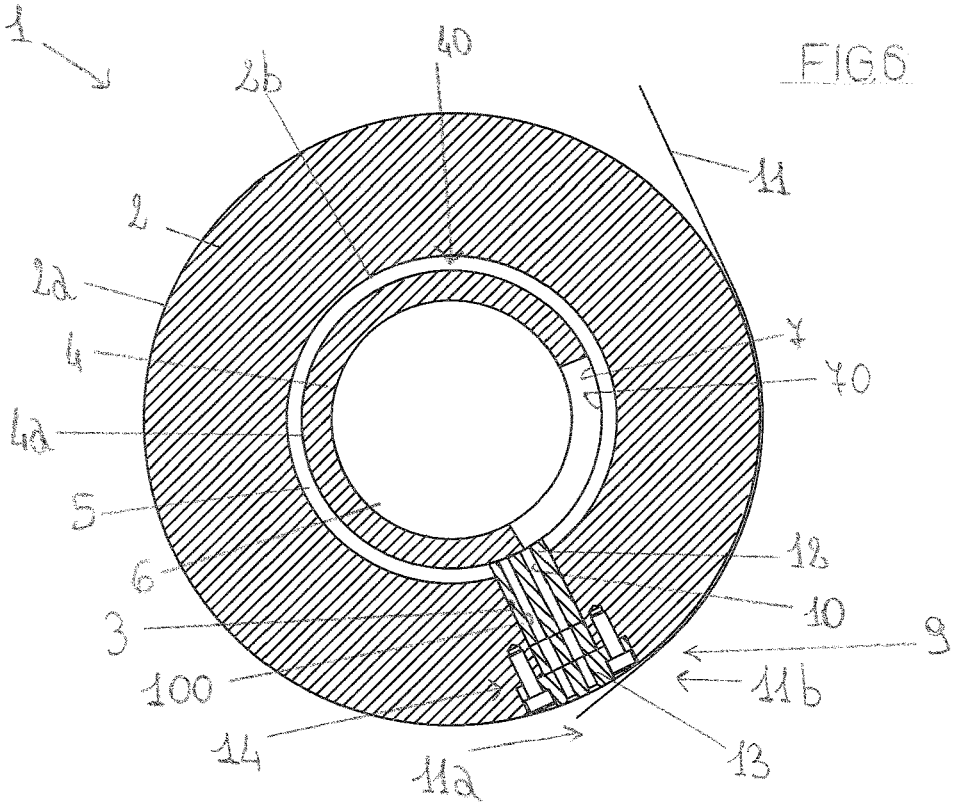

FIGS. 4-6 illustrate the second embodiment but the functioning cycle is the same for the first embodiment, for the second embodiment and for the further embodiments described herein.

In detail, FIGS. 4-6 illustrate an insert (9) comprising the second through-hole (10) and the fourth through-hole (100) arranged adjacent to one another along an arc of circumference of the roller (2). During the conveying of a sheet (11), when the sheet (11) is on the external surface (2*a*) of the roller (2) at the first through-hole (3), initially only a first part (11*a*) of the sheet (11) is aspirated against the external surface (2*a*) of the roller (2), because of the depression generated by the aspirating means (8), as the second through-hole (10) of the insert (9) transits at the opening (7) (FIG. 4). Subsequently a second part (11*b*) of the sheet (11) is aspirated against the external surface (2*a*) of the roller (2) by action of the depression generated by the aspirating means (8), as the fourth through-hole (100) of the insert (9) transits at the opening (7) (FIG. 5). At this point, the sheet (11) is conveyed and remains adhering to the external surface (2*a*) of the roller (2) due to the depression generated by the aspirating means (8) (FIG. 5). During the conveying, the first part (11*a*) of the sheet (11) will no longer be affected by the depression generated by the aspirating means (8) in the moment when the fourth through-hole (100) of the insert (9) transits at the external surface (4*a*) of the cylindrical member (40) (FIG. 6). In the same way, the second part (11*b*) of the sheet (11) will no longer be affected by the depression generated by the aspirating means (8) in the moment when the second through-hole (10) of the insert (9) also transits at the external surface (4*a*) of the cylindrical member (40).

With reference to FIG. 15, in a roller conveyor (110) the roller conveying units (1) are arranged in a pair, one adjacent to the other, in order to carry out the cutting, folding or interleaving operations. Multiple paper sheets are obtained from a paper sheet (11) in reel form in input, by means of a first roller conveying unit (101), by means of blades present on the external surface (2*a*) of the roller (2). A first single sheet (11) is conveyed towards a second roller conveying unit (102). At this point, the first sheet (11), which is external of the roller (2) of the first roller conveying unit (101), will have to pass to the second roller conveying unit (102). The passage occurs in the moment when the first sheet (11) transits at an insert (9) of the second roller conveying unit (102): the first sheet (11), owing to the depression generated by the aspirating means (8) of the second roller conveying unit (102), by means of the second through-hole (10) of the insert (9) of the second roller conveying unit (102), is aspirated against the external surface (2*a*) of the roller (2) of the second conveying unit (102). In the same way, specularly to the first roller conveying unit (101) and the second roller conveying unit (102), a third roller conveyor unit (103) and a fourth roller conveying unit (104) operate in the same way on a second sheet (112), Thereafter, at the moment when the first sheet (11) and the second sheet (112) are conveyed into a zone in which they mutually superpose, between the second roller conveying unit (102) and the fourth roller conveying unit (104), the interaction of the aspirating means (8) of the second roller conveying unit (102) and the fourth roller conveying unit (104) enables realising the interleaving between the first sheet (11) and the second sheet (112).

The roller conveying unit (1) for conveying a sheet (11) by means of aspiration, of the second invention of the present application, comprises: a frame; a roller (2) which is activatable in rotation with respect to the axis thereof, which is internally hollow and which comprises a first through-hole (3) which sets the outside of the roller (2) in fluid communication with the inside of the roller (2); a cylindrical surface (4*c*) which is arranged internally of the roller (2) and which is concentric to the roller (2). An annular chamber (5) is thus defined between the cylindrical surface (4*c*) and the internal surface (2*a*) of the roller (2). The roller conveying unit (1) further comprises aspirating means (8) for creating a depression in the annular chamber (5) and an insert (9).

Further, the insert (9): is borne by the roller (2); is inserted in the first through-hole (3) of the roller (2); is dimensioned so as to contact the cylindrical surface (4*c*); and comprises a second through-hole (10) which in turn is in communication with the outside of the roller (2) and extends through the first through-hole (3) and the annular chamber (5); and comprises an internal portion (12) which crosses the annular chamber (5) which is partly inserted in the first through-hole (3) and which is mobile along the first through-hole (3) and across the annular chamber (5) in order to take up a first position (A), wherein it enters into contact with the cylindrical surface (4*c*), thus preventing fluid communication between the outside of the roller (2) and the annular chamber (5) via the second through-hole (10), or a second position (B), wherein it is detached from the cylindrical surface (4*c*), placing the outside of the roller (2) in fluid communication with the annular chamber (5) via the second through-hole (10).

The roller conveying unit (1) further comprises: a cam (27) which is solidly constrained to the frame; a cam follower (31) which is borne by the roller (2) and which engages with the cam (27) and which commands the movement of the internal portion (12) of the insert (9); wherein the cam (27) is configured in such a way that, when the roller (2) rotates with respect to the axis thereof, the cam follower (31) runs on the cam (27) and thus moves the internal portion (12) of the insert (9) between the first position (A) and the second position (B), so that a sheet (11) located on the outside of the roller (2) and at the first through-hole (3) is aspirated against the external surface (2*a*) of the roller (2) by action of the depression generated by the aspirating means (8), and is consequently conveyed.

Figure 13:
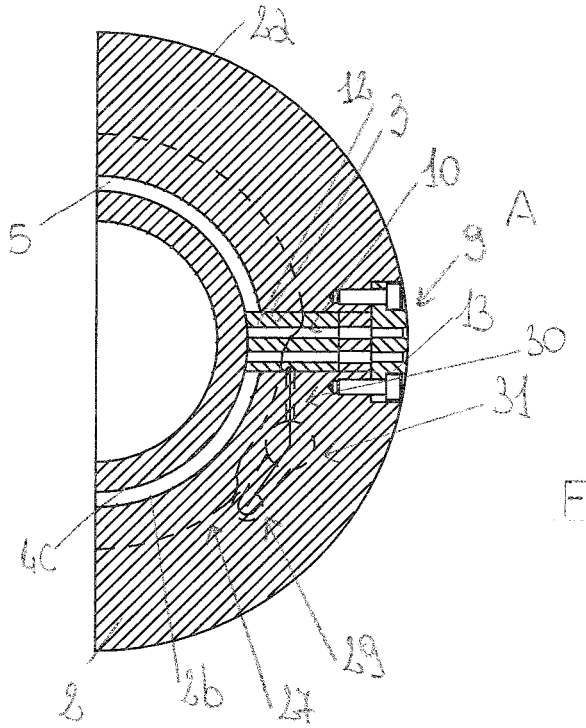
FIGS. 13-14 are front views illustrating a functioning cycle of a roller conveying unit according to a second invention.
Figure 14:
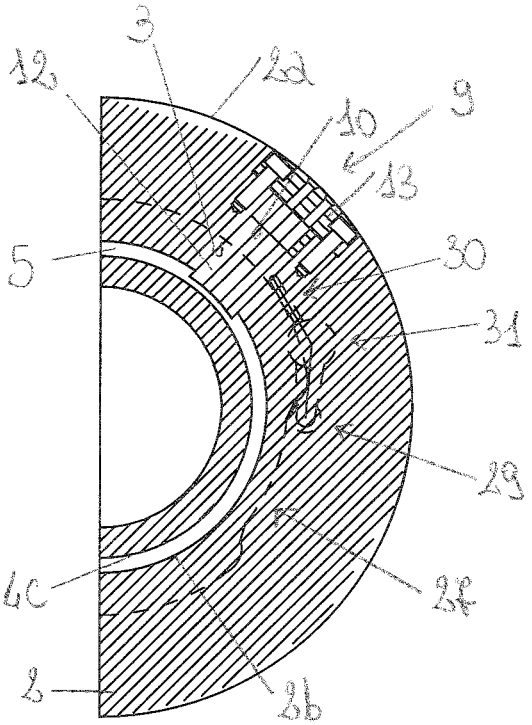

With reference to FIGS. 13-14, the cam follower (31) is connected to the internal portion of the insert and comprises an abutting element (29) which, during the rotation of the roller (2), slides on the cam (27), so as to move the internal portion (12) between the first position (A) (see FIG. 13) and the second position (B) (see FIG. 14).

The above-mentioned roller conveying unit (1) preferably comprises elastic means (not illustrated) which are interposed between the cam follower (31) and the internal portion (12) and which are compressed so as to press the internal portion (12) against the cylindrical surface (4*c*) and for progressively lengthening as the internal portion (12) gradually wears, thus guaranteeing in any case contact of the internal portion (12) against the cylindrical surface (4*c*).

During the conveying of a paper sheet there is a continuous dragging on the internal portion (12) of the insert (9) of the cylindrical surface (4*c*). For this reason, the internal portion (12) tends to be subject to wear during the use of the roller conveying unit (1) and there is consequently created a space between the internal portion (12) and the cylindrical surface (4*c*).

The elastic means (14) advantageously guarantee a longer working life of the insert (9) of the roller conveying unit (1), as the progressive lengthening of the elastic means (14) is such that the internal portion (12) fills the space created between the internal portion (12) and the cylindrical surface (4*c*), following wear on the internal portion (12).

It is understood that the above has been described by way of non-limiting example and that any technical-functional variants are considered to fall within the protective scope of the present technical solution, as claimed in the following.

The invention claimed is:

1. A roller conveying unit for conveying a sheet by means of aspiration, comprising:

a roller which is activatable in rotation with respect to the axis thereof, which is internally hollow and which comprises a first through-hole which sets the outside of the roller in fluid communication with the inside of the roller;

a cylindrical member which is arranged internally of the roller and which is concentric to the roller, an annular chamber being thus defined between the external surface of the cylindrical member and the internal surface of the roller;

the cylindrical member further comprising an opening;

aspirating means for creating a depression in the annular chamber;

an insert;

wherein the insert is borne by the roller, is inserted in the first through-hole of the roller, is dimensioned so as to contact the external surface of the cylindrical member and comprises a second through-hole which in turn is in communication with the outside of the roller and extends through the first through-hole and the annular chamber;

the positions and the dimensions of the first through-hole of the opening being selected in such a way that, when the roller rotates with respect to the axis thereof, the insert transits at the opening, temporarily placing the outside of the roller in fluid communication with the annular chamber via the second through-hole, so that a sheet located on the outside of the roller and at the first through-hole is aspirated against the external surface of the roller by action of the depression generated by the aspirating means, and is consequently conveyed.

2. The roller conveying unit of claim 1, wherein the opening is an undercut.

3. The roller conveying unit of claim 2, wherein: the cylindrical member is a tubular element and the hollow part of the tubular element defines an internal chamber; the aspirating means are further suitable for creating a depression in the internal chamber; the tubular element comprises a third through-hole which places the annular chamber in fluid communication with the internal chamber.

4. The roller conveying unit of claim 1, wherein: the cylindrical member is a tubular element and the hollow part of the tubular element defines an internal chamber; the aspirating means are further suitable for creating a depression in the internal chamber; the opening is a through-hole which places the annular chamber in fluid communication with the internal chamber.

5. The roller conveying unit of claim 1, wherein the insert is extractable from outside the roller in order to be replaced.

6. The roller conveying unit of claim 1, wherein the opening is shaped as a slit which extends along an arc of circumference of a corresponding transversal section of the cylindrical member.

7. The roller conveying unit of claim 1, wherein the insert comprises: an internal portion which crosses the annular chamber up to contacting the external surface of the cylindrical member and which is partly inserted in the first through-hole; an external portion which is fixed to the roller; elastic means which are interposed between the external portion and the internal portion and which are compressed so as to press the internal portion against the external surface of the cylindrical member and for progressively lengthening as the internal portion gradually wears, thus guaranteeing in any case contact of the internal portion against the external surface of the cylindrical member.

8. The roller conveying unit of claim 7, wherein the insert comprises a telescopic conduit and wherein the telescopic conduit is inserted in the second through-hole and between at least the internal portion and the external portion.

9. The roller conveying unit of claim 7, wherein the elastic means form a further portion of the insert, are made of an elastically deformable material and are interposed between the external portion and the internal portion.

10. The roller conveying unit of claim 7, wherein the elastic means comprise a spring interposed between the external portion and the internal portion; wherein the internal portion comprises a housing for a spring which receives the spring and wherein the external portion comprises a first seat for receiving regulating means for increasing or reducing the compression of the spring.

11. The roller conveying unit of claim 1, wherein the insert comprises a first plurality of through-holes, which first plurality of through-holes comprises the second through-hole; and wherein the through-holes of the first plurality of through-holes are arranged adjacent to one another along an arc of circumference of the roller.

12. The roller conveying unit of claim 1, wherein the roller comprises a second plurality of through-holes, which second plurality of through-holes comprises the first through-hole; and wherein the through-holes of the second plurality of through-holes are arranged adjacent to one another along a parallel direction to the axis of rotation of the roller.

13. A roller conveying unit for conveying a sheet by means of aspiration, comprising:

a frame;

a roller which is activatable in rotation with respect to the axis thereof, which is internally hollow and which comprises a first through-hole which sets the outside of the roller in fluid communication with the inside of the roller;

a cylindrical surface which is arranged internally of the roller and which is concentric to the roller;

an annular chamber being thus defined between the cylindrical surface and the internal surface of the roller;

aspirating means for creating a depression in the annular chamber;

an insert;

wherein the insert: is borne by the roller; is inserted in the first through-hole of the roller; is dimensioned so as to contact the cylindrical surface; and comprises a second through-hole which in turn is in communication with the outside of the roller and extends through the first through-hole and the annular chamber; and comprises an internal portion which crosses the annular chamber which is partly inserted in the first through-hole and which is mobile along the first through-hole and across the annular chamber in order to take up a first position, wherein it enters into contact with the cylindrical surface, thus preventing fluid communication between the outside of the roller and the annular chamber via the second through-hole, or a second position, wherein it is detached from the cylindrical surface, placing the outside of the roller in fluid communication with the annular chamber via the second through-hole;

and in that the roller conveying unit comprises:

a cam which is solidly constrained to the frame;

a cam follower which is borne by the roller and which engages with the cam and which commands the movement of the internal portion of the insert;

wherein the cam is configured in such a way that, when the roller rotates with respect to the axis thereof, the cam follower runs on the cam and thus moves the internal portion of the insert between the first position and the second position, so that a sheet located on the outside of the roller and at the first through-hole is aspirated against the external surface of the roller by action of the depression generated by the aspirating means, and is consequently conveyed.

14. The roller conveying unit of claim 13, comprising elastic means which are interposed between the cam follower and the internal portion of the insert and which are compressed so as to press the internal portion against the cylindrical surface and for progressively lengthening as the internal portion gradually wears, thus guaranteeing in any case contact of the internal portion against the cylindrical surface.

* * * * *